US005688161A

United States Patent [19]

Gregory, III et al.

[11] Patent Number: 5,688,161

[45] Date of Patent: Nov. 18, 1997

[54] METHOD AND APPARATUS FOR SHARPENING AND CLEANING SCALLOPED-EDGED BLADES

[75] Inventors: J. Lee Gregory, III, Richmond; William H. Stevens, II, Deltaville, both of Va.

[73] Assignee: Philip Morris Incorporated, New York, N.Y.

[21] Appl. No.: 506,290

[22] Filed: Jul. 24, 1995

Related U.S. Application Data

[63] Continuation-in-part of Ser. No. 182,443, Jan. 18, 1994, Pat. No. 5,435,771.

[51] Int. Cl.[6] ..... B24B 3/58

[52] U.S. Cl. ..... 451/45; 451/66; 451/421; 451/208

[58] Field of Search ..... 451/45, 66, 65, 451/73, 419, 420, 421, 208, 190, 192

[56] References Cited

U.S. PATENT DOCUMENTS

| | | | |
|---|---|---|---|
| 106,897 | 8/1870 | Wegner | 451/65 |
| 1,053,331 | 2/1913 | Waring | 451/419 |
| 2,997,825 | 8/1961 | Hansen | 451/419 |
| 3,036,408 | 5/1962 | Hansen | 451/419 |
| 3,540,166 | 11/1970 | Crumley | 451/420 |
| 4,528,777 | 7/1985 | Bernstein et al. | 451/45 |
| 4,829,721 | 5/1989 | Wright | 451/419 |

*Primary Examiner*—Robert A. Rose

*Attorney, Agent, or Firm*—Charles E. B. Glenn; James E. Schardt; James T. Moore

[57] ABSTRACT

A sharpening and cleaning apparatus for sharpening scalloped-edged blades in a carton slitting machine includes at least two rotating cylindrical hones mounted on a pneumatically controlled actuator, and a pair of blade cleaning brushes mounted on a separate actuator. A sharpening operation is initiated by a machine operator as needed to maintain blade sharpness, and is performed automatically by the apparatus controls. The hone actuator positions the rotating hones in contact with opposing sides of a cutting edge of the slitting blade as the blade moves past the hones at reduced speed. A first hone is rotated in a direction opposite to the direction of the blade and a second hone is rotated in the same direction of the blade. During sharpening, the hones execute several reciprocating axial movements to stroke the blade. Prior to the operation of the hones the actuator positions the brushes in contact with the blade and causes the brushes to rotate to remove debris from the blade.

30 Claims, 9 Drawing Sheets

METHOD AND APPARATUS FOR SHARPENING AND CLEANING SCALLOPED-EDGED BLADES

This is a continuation-in-part of U.S. Patent application Ser. No 08/182,443, filed Jan. 18, 1994, which is to issue Jul. 25, 1995, as U.S. Pat. No. 5,435,771.

FIELD OF THE INVENTION

The present invention relates to sharpening and cleaning a scalloped-edged, endless band blade in a machine, particularly suited for slitting cigarette cartons.

BACKGROUND AND SUMMARY OF THE INVENTION

Slitting machines with scalloped edged blades are used in the smoking products industry for slitting open cartons and packages of cigarettes to recover tobacco rods, which are then fed to ripper machines to reclaim tobacco and tobacco filler for use in other products. A problem involved in slitting cigarette cartons is that, as the slitting blades dull, the blades shred or rip the packaging materials, instead of cutting them cleanly. The shredded paper, paperboard, plastic wrapper, foil and/or cigarette filter material become mixed in with the recovered tobacco filler, creating quality control problems and drastically decreasing the value of the reclaimed tobacco. In addition, the plastic wrapper material tends to melt onto the blades and adhere with paper dust and other debris.

The use of well sharpened blades greatly reduces the amount of paper that gets mixed in reclaimed tobacco filler. Maintaining sharp blades in slitting machines proves to be difficult in practice, however. Slitting cigarette cartons and packages is a high wear process and blades dull to unacceptable quality levels quickly, often after cutting only a few hundred cartons. Current practices include using an edge hardened blade until such time that the cutting edges dull, and then replacing the blade, a practice which is costly in both maintenance time and material.

U.S. Pat. No. 4,829,721 to Wright discloses a honing apparatus for sharpening endless band type blades used in bun slicing machines in the bread industry. The Wright patent apparatus includes a supporting frame holding a pair of fixed elongated hones. The frame is positioned on a bun slicing machine with the hones in proximity with a cutting blade. During the sharpening procedure, the frame is moved so that the hones are positioned at either side of a blade, and the frame is then tilted so that the hones contact both sides of the cutting edge. Sharpening of the blade is effected by the movement of the blade past the hone. The hones also perform two reciprocating strokes in the plane of the blade path during the sharpening procedure.

The Wright apparatus has limitations that make it impractical for use to sharpen blades on a carton slitting machine. Only a small constant area of the hones contacts the blades during a sharpening procedure, and over time the hones are prone to developing flats and loss of abrasive at the contact area. The hones in the Wright patent apparatus must be manually rotated between sharpening operations to expose fresh abrasive to the blades. Because the blades in a carton slitting machine can require sharpening after a few hundred cartons (usually a few minutes), manual adjustments would be labor and time intensive. In addition, carton slitters must cut through plastic and other packaging material which can collect on the blade. During sharpening, this residue can build up on and foul the hones.

Furthermore, it appears that the sharpening operation is done at the relatively slow speed of the moving bun slicing blade. The finish on the blade in this type of honing operation is unacceptable for a carton slitting operation.

The present invention, generally, provides a blade cleaning and sharpening apparatus for scalloped edged blades in carton slitting machines.

More particularly, the present invention provides a blade sharpening apparatus that can be selectively utilized to clean and sharpen blades in a carton slitting machine without removing the blades from the machine.

The present invention provides a blade sharpening apparatus which hones carton slitting blades to a sharpness required to maintain quality standards that will avoid introducing paper and other unwanted material to tobacco filler reclaimed from slit cartons. In addition, the present invention provides a device operative in conjunction with (preferably before) the sharpening sequence which cleans the blades so as to remove packaging debri and any burrs or other extraneous material that may have been generated during the slitting operation.

In accordance with a preferred embodiment of the present invention, the rotary hone sharpening apparatus comprises rotatable brushes, air motors for rotationally driving each brush and pivotal supports arranged such that each brush, together with its air motor, is movable between a retracted position and an operative position. At the operative positions, the brushes contact opposite sides of the blade. The brushes are oriented so that their axes of rotation are parallel to a direction of movement of the blade and so that the contacting portions of the brushes rotationally move from a rearward portion of the blade toward the cutting edge of the blade. Preferably, the brushes are wire brushes.

In accordance with another aspect of the invention, the apparatus includes at least two cylindrical hones, each hone being carried on a spindle. The spindles are mounted in bearing sleeves and coupled to a flexible drive shaft for high speed rotation. Flexible drive shafts facilitate the adjustable positioning of the hones relative to the cutting edge of the blade to be sharpened. In the alternative, air motors are coupled with each of the hones instead of flexible drive shafts.

At least one hone is positionable at each side of a blade cutting edge for sharpening the blade cutting edge. Sharpening is performed on a moving blade, with at least one hone rotating so that a contact surface of the hone is travelling in a direction opposite to the direction of travel of the blade and at least one hone is rotating so that a contact surface is moving in the same direction as the direction of travel of the blade. The hone rotating opposite to the blade performs the sharpening operation and the hone rotating in the same direction operates to smooth and deburr the blade edge. According to a presently preferred embodiment, the hones rotate at least 15,000 rpm and more preferably at 20,000 rpm.

In another aspect of the invention, the hones are caused to execute several transverse movements to stroke the blade, exposing more of the hone abrasive to the blade edge to improve sharpening and evenly distribute the wear characteristics of the hones.

In accordance with a further aspect of the invention, the bearing sleeves are each carried in a clamp which is mounted to a pneumatic rotary actuator. The clamps are pivotable for positioning the hones at an appropriate angle to the blade cutting edges. The actuator executes a pivot movement parallel to the plane of the blades causing the hones to move into an engagement location at either side of a blade. The rotary actuator is mounted to a linear actuator for moving the rotary actuator, and consequently the hones, in the direction of the blade width for a sharpening stroking movement.

The present invention provides a blade sharpening device which is installed on a carton slitting machine and can be operated by a machine operator, as needed, to sharpen the slitting blades. Through a circuit of interconnected timing devices, the blade sharpening device of the present invention automatically engages the blade cutting edge and performs a predetermined sharpening operation sequence without operator intervention.

A further aspect of the present invention provides a method for cleaning and sharpening a scalloped edged blade in a carton slitting machine that includes the steps of reducing the linear speed of the cutting blade, contacting the blade with rotating brushes, retracting the brushes away from the cutting blade as the brushes continue to rotate, rotating the cylindrical hones, engaging a cutting edge portion of a blade with the rotating hones, stroking the cutting edge portion with the rotating hones in a transverse direction several times as the hones rotate, and retracting the hones away from the cutting blade as the hones rotate.

Other aspects and advantages of the present invention will become evident from the following:

BRIEF DESCRIPTION OF THE DRAWING

The present invention can be further understood with reference to the following description in conjunction with the appended drawings, wherein like elements are provided with the same reference numerals. In the drawings.

DETAILED DESCRIPTION OF PREFERRED EMBODIMENTS

Figure 1:
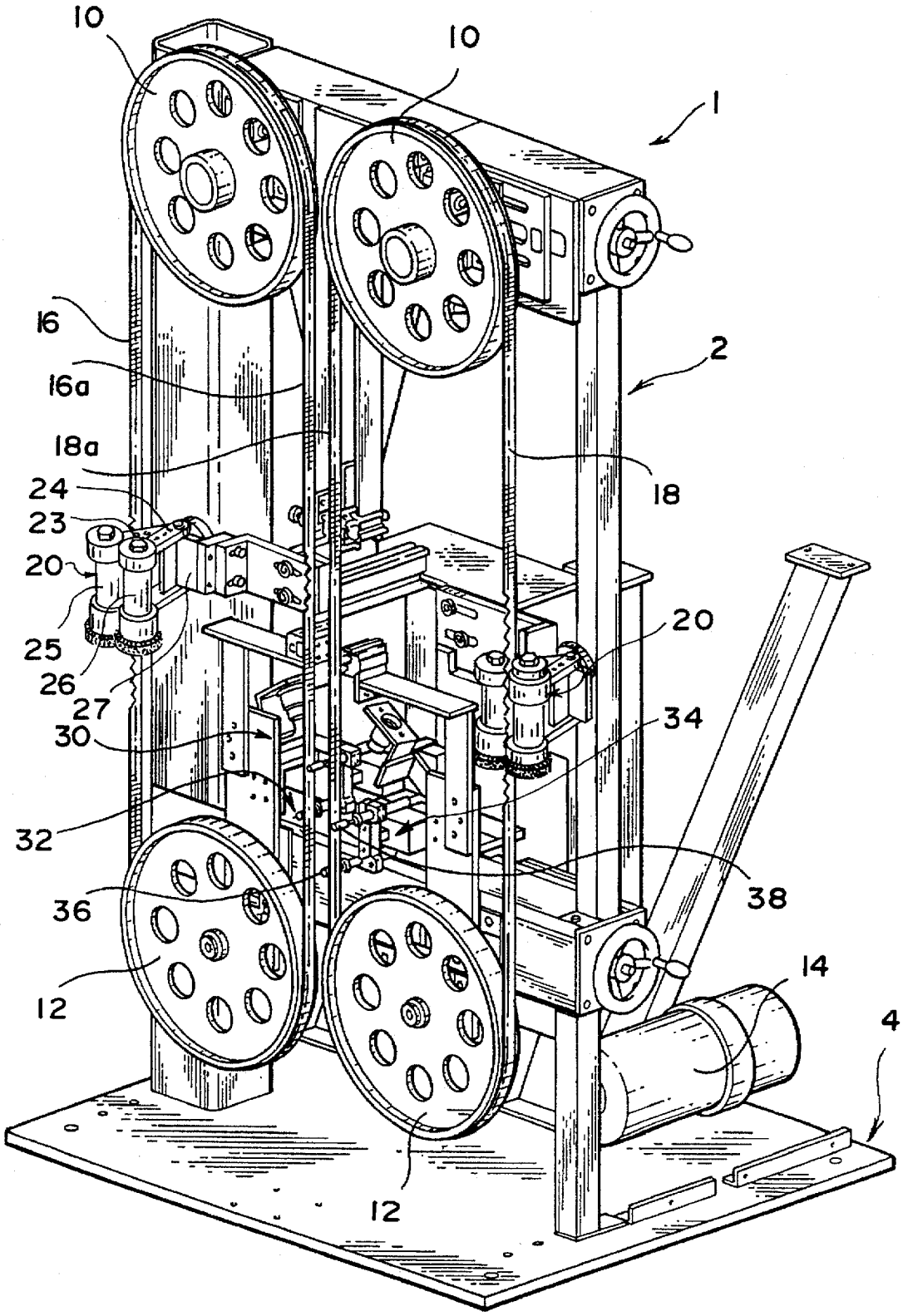
FIG. 1 is a perspective view of a carton slitting machine constructed in accordance with a preferred embodiment of the present invention and featuring a blade cleaning assembly and a blade sharpener assembly of the present invention.

Referring to FIG. 1, a preferred embodiment of the present invention provides a carton slitter 1 for cutting open cigarette cartons to reclaim tobacco from the cigarette rods. The carton slitter 1 is described herein to provide a more complete understanding of the blade sharpener of the present invention, but does not constitute a part of the invention. The carton slitter 1 includes a frame 2 mounted on a base 4. Two slitter blades 16 and 18 are arranged on the carton slitter 1 in a parallel, spaced relationship a predetermined distance apart in the region between upper and lower pulleys 10 and 12. Cutting edges 16*a*, 18*a* of the blades 16, 18 are generally parallel and arranged to contact a carton in the same plane.

As used herein, "carton" refers to a box that contains several, generally ten, individual packets of cigarettes or smoking articles. A "packet" is used to refer to a package of several, typically twenty, cigarettes or smoking articles. In addition, the use of terms indicating direction or orientation, such as "right," "left," "upper," and "lower," are to facilitate the description of the invention as illustrated by the accompanying drawings and should not be given meaning otherwise.

The blades 16, 18 are scalloped edged, endless band blades. Each blade 16, 18 is carried on an upper idler pulley 10 and a lower drive pulley 12. The lower drive pulleys 12 transmit drive force to the blades and the upper idler pulleys 10 maintain the blades 16, 18 in proper orientation and tension. A drive motor 14 mounted to the base 4 is connected to the pulleys 12 by conventional means, for example a drive belt or chain, to drive the pulleys.

A carton feed conveyor and product and waste recovery conveyors are not illustrated in FIG. 1 so as to provide a view of the underlying structure. As will be appreciated, cigarette cartons to be slit are conveyed to the blades 16, 18 from left to right in the FIG. 1. The blades 16, 18 are positioned to slit a carton simultaneously on two operational planes. One blade slits a side panel of the carton, cutting the tops from individual packet tops to expose the cigarette rods. The second blade cuts through the carton and packets to separate the filters from the cigarette rods. The slit carton (which is now open along opposing sides) passes from the slitting machine to a unit that ejects the tobacco rods from the carton to a ripper machine that separates the tobacco from the paper tube.

Cigarette packets generally include an outer plastic wrapper, a paper or paperboard package and an inner freshness wrapper of foil- or plastic-coated paper. Cigarette filters contain treated natural and artificial fiber materials. Slitting cartons, packets, and the contents is a high wear process, and blades tend to dull very quickly. In addition, friction from the blade 16, 18, melts portions of the plastic package wrap and inner freshness wrapper, which leaves a residue that builds up on the blades 16, 18.

A blade cleaning assembly 20 is shown in FIG. 1 mounted on the frame 2 in conjunction with each of the blades 16, 18. The cleaning assemblies 20 are positioned in an operative position in contact with the blades 16, 18 for cleaning the blades upon an operator command, and are movable to a retracted position out of contact with the blades 16 and 18.

Figure 2:
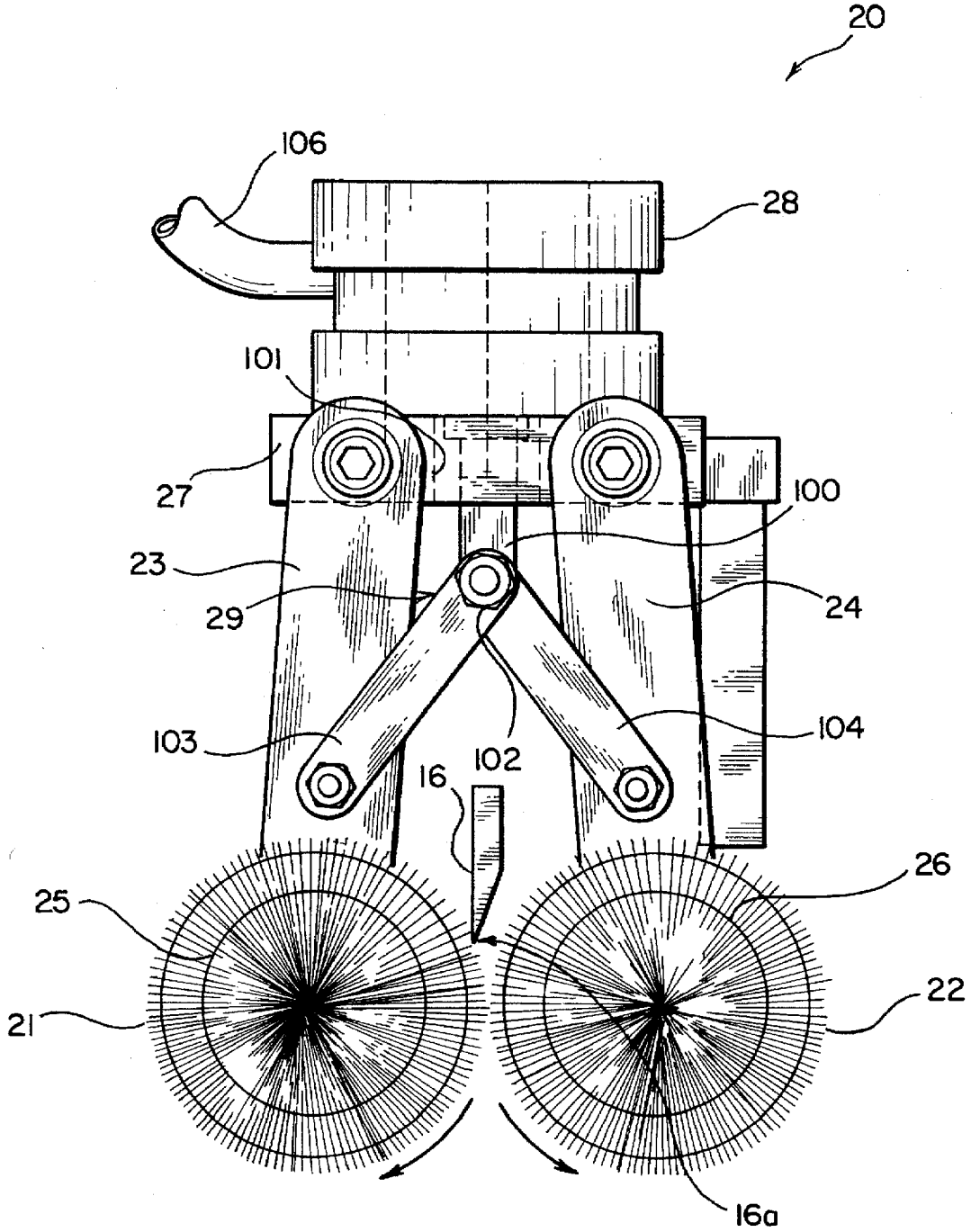
FIG. 2 is a top planar view of the blade cleaning assembly of FIG. 1.
Figure 3:
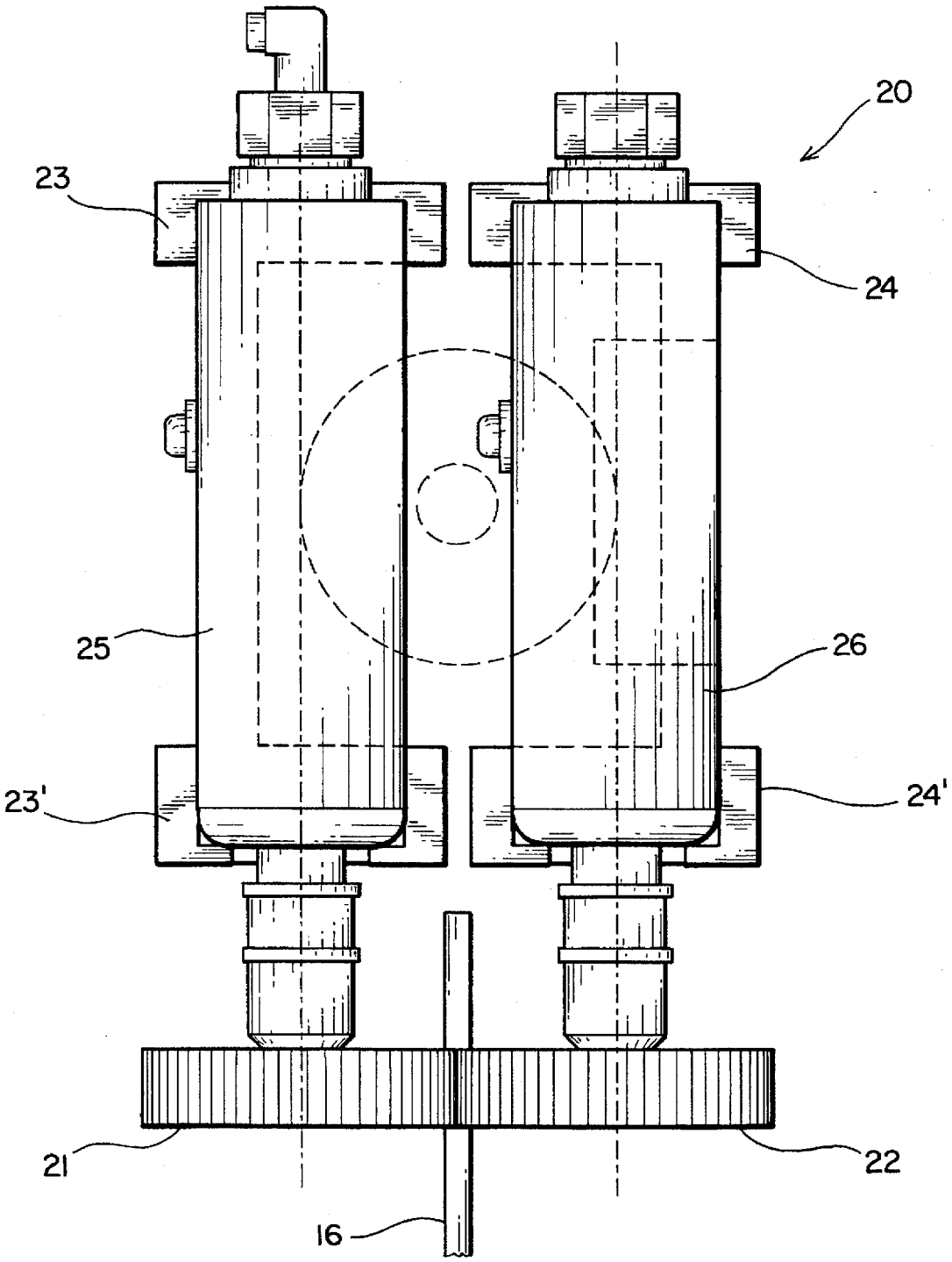
FIG. 3 is a side planar view of the blade cleaning assembly of FIG. 1.

Referring to FIGS. 2 and 3, the blade cleaning assembly 20 preferably comprises a pair of rotatable brushes 21, 22, preferably wire brushes, each driven by an air motor 25 and 26, respectively. The top portions of the air motors 25 and 26 are supported by a first pair of pivotal arms 23 and 24, respectively, and the bottom portions of the air motors 25 and 26 are attached to a second pair of pivotal arms 23' and 24', respectively. The upper set of arms 23 and 24 are pivotally attached to an upper portion of a fixture piece 27, which is itself rigidly attached to the framework of the carton slitter 10 The lower set of arms 23' and 24' are attached in similar fashion to a lower portion of the fixture piece 27. The pivotal arms 23, 24, 23' and 24' permit the brushes 21, 22 to pivot toward or away from contact with the blade 16 responsively to an actuator 28 and drive linkage 29.

The actuator 28 is affixed to the opposite side of the fixture piece 27 from the pivotal arms 25 and 26 and causes a drive pin 100 to translate controllably in a direction toward and away from the brushes 21 and 22. Preferably, the drive pin 100 extends through an aperture 101 provided in a central portion of the fixture piece 27 and is attached to a central portion of a vertical pin 102. The upper end of the vertical pin 102 is pivotally connected to ends of a pair of lever arms 103 and 104, which in turn are pivotally attached at their opposite ends to the pivotal arms 23 and 24, respectively. Preferably, the lower end of vertical pin 102 is attached to ends of a second pair of lever arms 103' and 104' and the lower pair of pivotal arms 23' and 24' in a similar fashion.

Preferably, the actuator 28 is a "pancake" type, air cylinder of the type available from Bimba Manufacturing Co., Nonee, Ill. 60449, Model S-0 with a ½ inch stroke and a 1 and 1/16 inch bore. However, the desired actuation could be effected using other types and models of actuators, the selection of which being a matter of choice to one of ordinary skill in the pertinent art. The actuator 28 is communicated to a controller and source of pressurized air through an air line 106.

Referring now to FIG. 2, to bring the brushes 21 and 22 into their operative positions in contact with the blade 16, the air motors are first caused to spin so that at no time would a stationary piece of the either brush come into contact with the moving bade 16. The actuator 28 is then activated to cause the drive pin 100 to translate along its longitudinal axis in a direction away from the brushes 21 and 22, which motion causes the lever arms 103 and 104 (together with the lower lever arms 103' and 104') to draw the brushes 21 and 22 together into operative contact with the blade 16. Preferably, the brushes are kept in their operative position for approximately 10 to 20 seconds, more preferably about 15 seconds, during which time the air pressure to the actuator 28 is maintained at approximately 40 psi to bias the brushes 21 and 22 sufficiently into contact with the blade to effect cleaning. The brushes continue to spin throughout the cleaning phase and throughout the time it takes for the actuator 28 to return the brushes 21 and 22 to their retracted positions at the conclusion of the cleaning phase. Once there, it is preferable to continue to spin the brushes for a short period to leave some margin against the prospect of a slow retraction possibly causing a stationary brush to contact and possibly damage the blade 16.

The brushes 21, 22 are mounted on shafts of motors 26, 27. The motors 26, 27 are preferably air motors and are connected to an appropriate source of compressed air. As may be seen in FIG. 1, the brushes 21, 22 are mounted with the respective axes of rotation parallel to the direction of travel of the blades 16, 18. The brushes 21, 22, therefore, rotate in planes perpendicular to the blade length. As shown in FIG. 2, the brushes 21, 22 rotate to brush the blade 16 from a rear edge portion along the blade 16 toward the cutting edge **16*a* of the blade 16**, thus throwing debris away from the cutting edge.

Although air motors 26 and 27 are the preferred devices for spinning the brushes 21, 22, other suitable driving arrangements could be selected such as electrical motors, arrangements with remote motors and flexible drive shafts or the like.

Referring now to FIG. 1, the blade sharpener apparatus 32 of the present invention is mounted in the frame 2 in proximity to the cutting edges **16*a* of the blade 16. A second blade sharpener apparatus 34 is mounted in proximity to the cutting edge 18*a* of the blade 18. The blade sharpener apparatuses 32, 34 are positioned on the frame 10 to be readily utilized for blade sharpening, but otherwise remain clear of the blades 16, 18** and the carton slitting process.

Figure 4:
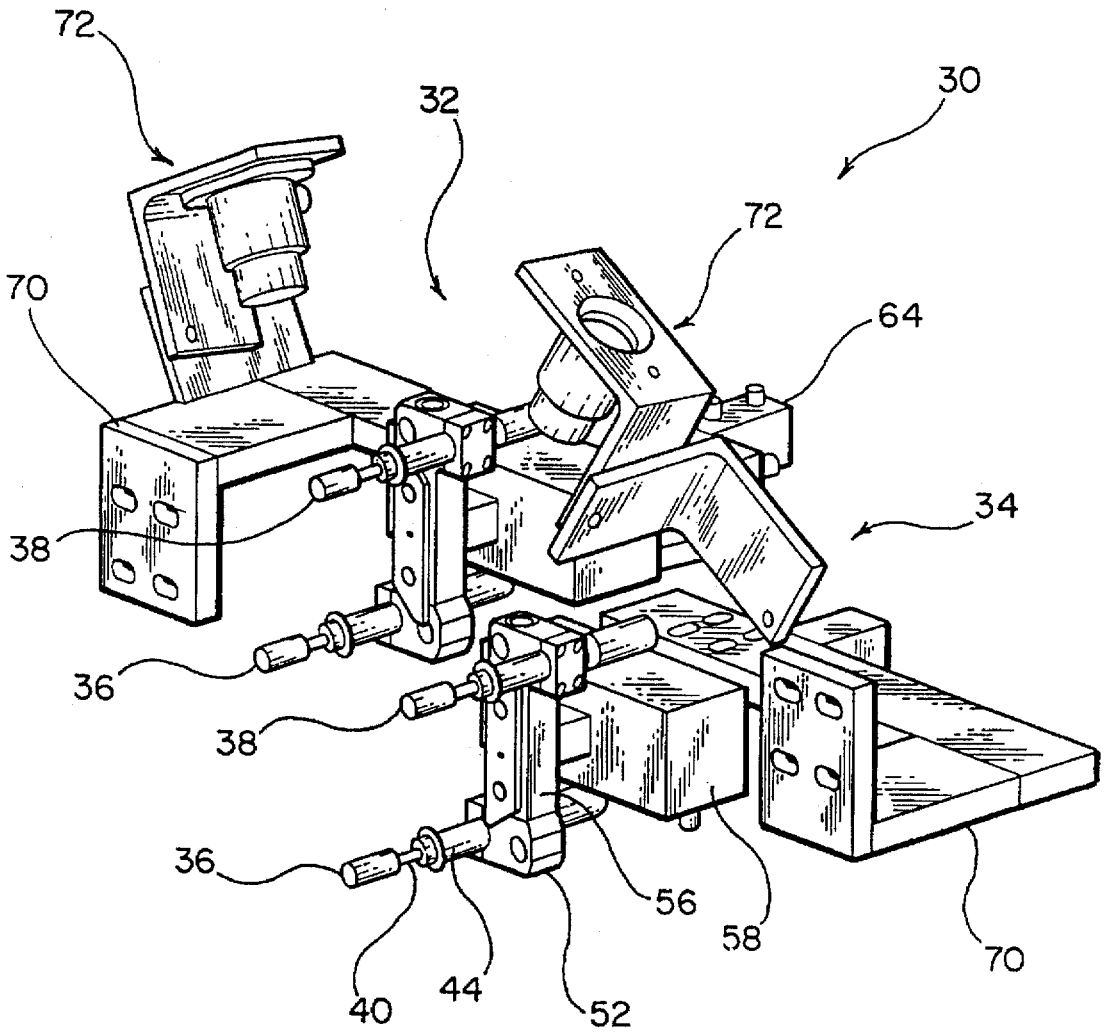
FIG. 4 is a perspective view of the blade sharpener assembly of FIG. 1.

Referring now also to FIG. 4, each of the sharpening apparatuses (assemblies) 32, 34 includes a pair of sharpening hones 36, 38, extending from the apparatus to the blades 16, 18. As shown in FIG. 1, the sharpening hones 36, 38 are positioned on opposing sides of the blades 16, 18. This arrangement permits the sharpening apparatus 32, 24 to engage both sides of the cutting edge **16*a*, 18*a*** during a sharpening operation.

Figure 5:
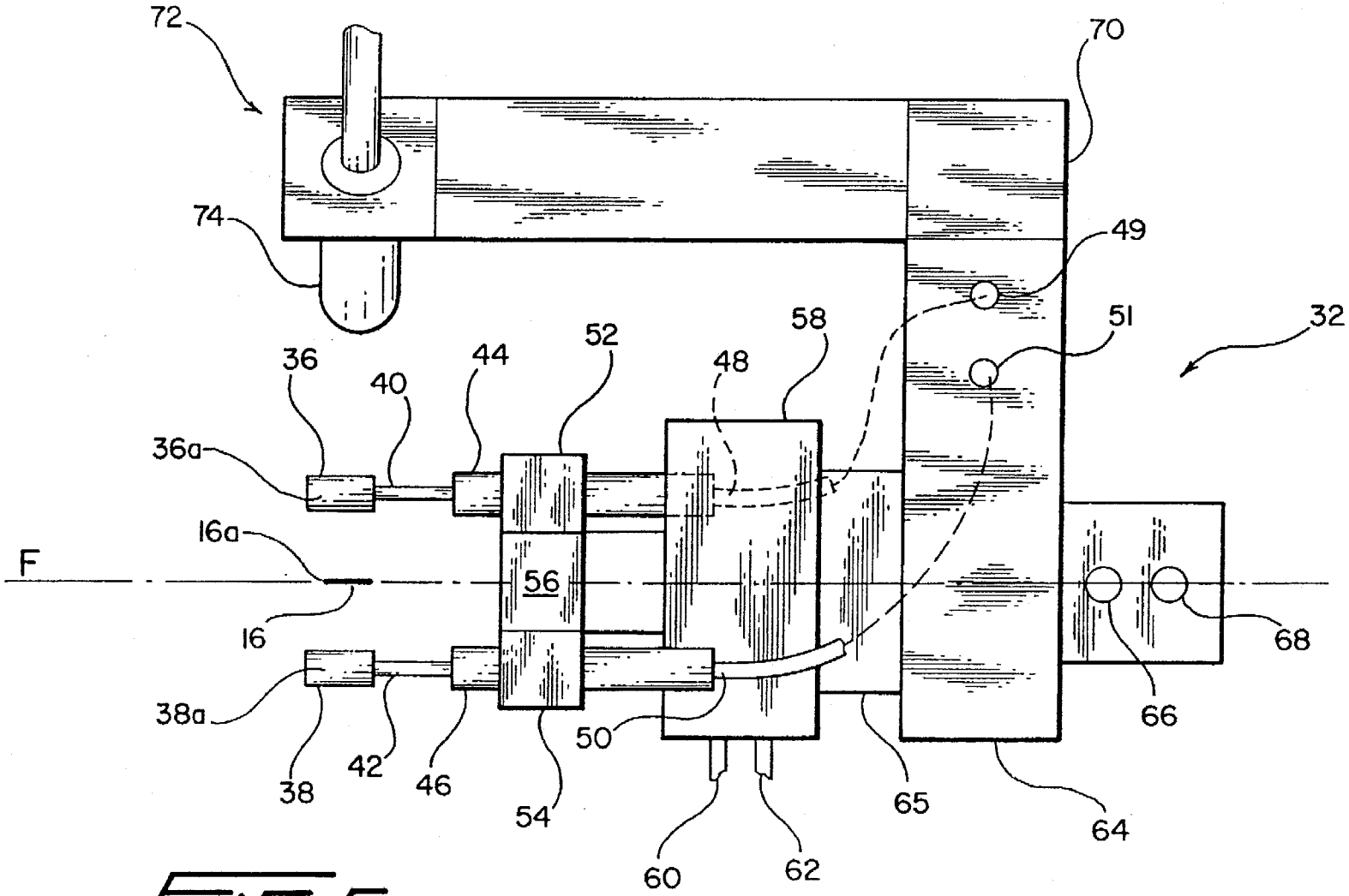
FIG. 5 is a top view of the blade sharpener of FIG. 4.

FIG. 5 is a top view of the sharpening apparatus 32 of FIG. 4. The apparatus is carried on a mounting bracket 70 that is mountable on the frame of the carton slitting machine 1.

The apparatus 32 includes a lower sharpening hone 36 and an upper sharpening hone 38. The hones 36, 38 are cylindrically shaped sharpening stones, one half inch in diameter, having an abrasive surface **36*a*, 38*a*. The abrasive characteristics of the hones 36, 38 are selected for sharpening the slitting blades as is known in the art. Each hone 36, 38 is carried on a spindle 40, 42, respectively. The spindles 40, 42 are each mounted in a bearing sleeve, 44, 46 that is coupled to a flexible drive shaft 48, 50 (shown in part). The flexible drive shafts 48, 50 transmit rotational force to the spindles 40, 42 for rotating the stones 36, 38. The flexible drive shafts 48, 50 are coupled to drive motors 49, 51 which provide the drive force to rotate the hones. The use of flexible drive shafts allows the motors 49, 51 to be remotely located from the bearing sleeves 44, 46 in a convenient location. The drive motors 49, 51 are shown mounted on the mounting bracket 70**, and may be, alternatively placed at other convenient locations.

Each of the bearing sleeves 46, 48 is mounted in a clamp 52, 54 attached at opposing ends of a pivot rod 56. The clamps 52, 54 are pivotably mounted on the pivot rod 56 to permit the hones 36, 38 to be set at a desired angle in relation to the cutting edge 16a for forming a bevel during sharpening. The pivot rod 56 is rotatably coupled to a pneumatic rotary actuator 58. The rotary actuator 58 causes the pivot rod 56 to rotate about axis F to bring the hones 36, 38 into engagement with the blade edge **16*a*. The rotary actuator 58 is provided with two pneumatic fittings 60, 62 to couple the rotary actuator to a source of pressurized air (not shown) for pneumatically controlling the rotation of the pivot rod 56**.

The rotary actuator 58 is attached to a linear actuator 64. The linear actuator 64 has a slide 65 that moves along axis F. Movement of the slide 65 causes the rotary actuator 58 and, consequently, the hones 36, 38, to move parallel to axis F. The linear actuator provides reciprocal movement of the hones 36, 38 is provided for stroking the blade edges **16*a*, during sharpening, as has been described. The linear actuator 64 is provided with two pneumatic fittings 66, 68 to couple the linear actuator 64** to a source of pressurized air (not shown) for pneumatically operating the slide.

The linear actuator 64 is fastened to the mounting plate 70 for mounting the sharpening apparatus 32 to the carton slitting machine frame 2.

The sharpening apparatus 32 of the present invention is provided with means 72 for removing dust and debris from the hones during the sharpening operation. In a preferred embodiment of the invention, the means for removing dust and debris comprises an air flow amplifier 74 arranged to direct a blast of air onto the hones and blade. The air flow amplifier 74 is connected to a source of pressurized air (not shown) and serves to direct and concentrate an air flow for blowing metal dust from sharpening and the paper, plastic and other debris that collects on the hones during sharpening.

Figure 6:
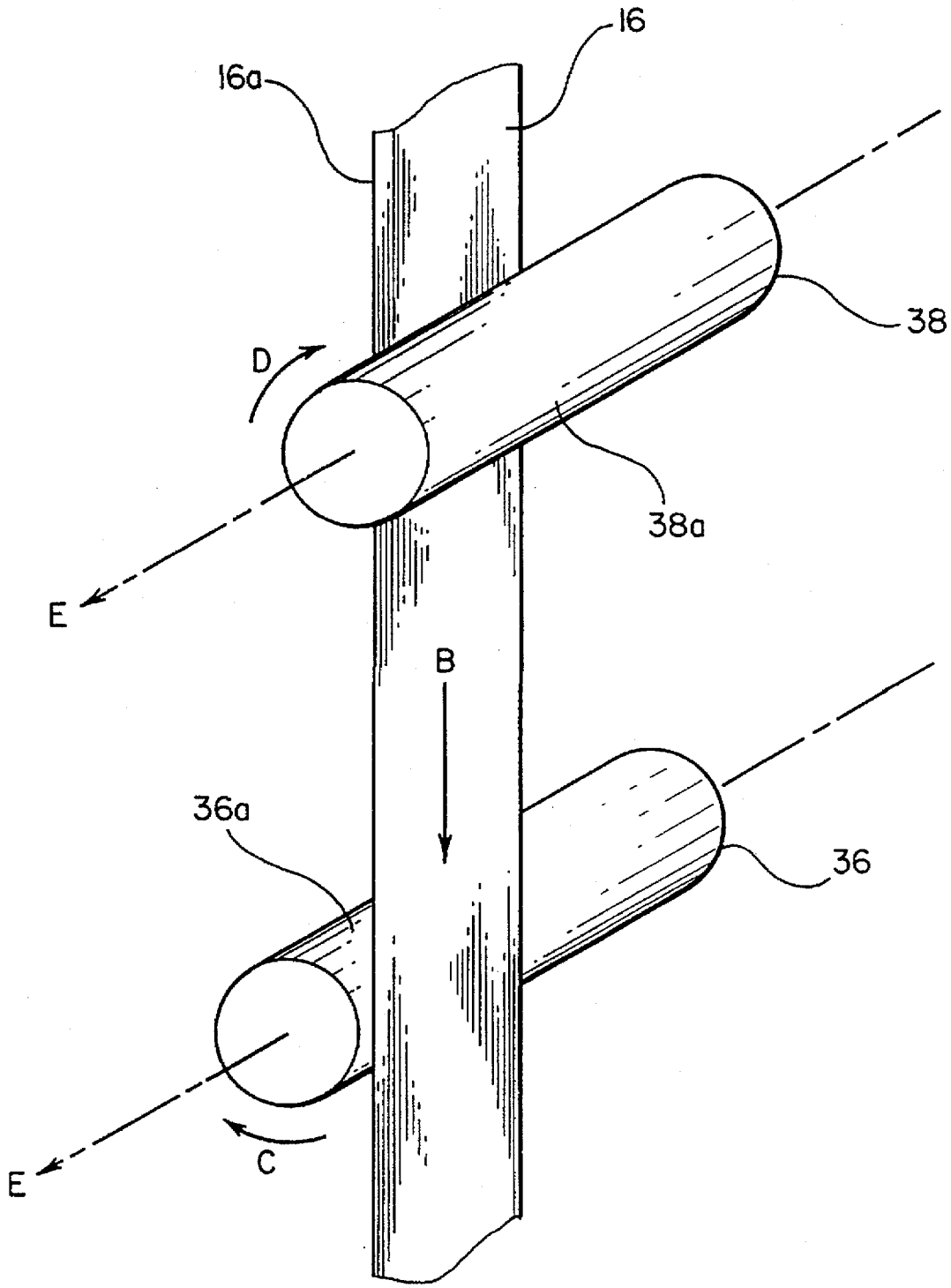
FIG. 6 is a schematic end view of the hones of FIG. 4 contacting the blade.

FIG. 6 is a schematic view of the hone 36, 38 positions relative to the blade 16 for sharpening. The hones 36, 38 are positioned on opposing sides of the blade 16, and vertically spaced apart, with the hone 38 positioned above the hone 36.

The direction of travel of the blade, from top to bottom, is indicated by arrow B. During the sharpening sequence, the operational blade speed of about 4500 to 5500 feet per minute is reduced to a sharpening speed of about 450 to 690 feet per minute. The slowing of the blade 16 is necessary to maintain good contact between the hones 36, 38 and the blade and scallops. At the high operational speed and with the high tension of the blade 16, the scalloped edges of the blade bumping against the hones 36, 38 would cause an oscillation in the blade resulting in the hones intermittently losing contact with the blade edge. It has been found that at a lower speed, which is 690 feet per minute in a presently preferred embodiment, the hones 36, 38 are able to maintain continuous contact with the blade 16.

The hones 36, 38 are moved by the rotary actuator to contact the cutting edge 16*a* with sufficient contact pressure to deflect slightly the edge 16*a* of the blade 16. The slight twist, and resulting torsion in the blade 16 as it passes from the upper hone 38 to the lower hone 36 assists in the hones maintaining contact with the blade during sharpening.

The hones 36, 38 are angled so that honing surfaces 36*a* and 38*a* contact the blade 16 at the cutting edge 16*a* for forming a desired bevel on to the edge. In a preferred embodiment of the invention, the hones are angled so that a 5° bevel is formed in sharpening. In practice, the hones 36, 38 are angled at 7° to 10° to the operational plane of the blade 16 to ensure that the hones contact the blade at the cutting edge 16*a*. Because the blade 16 is deflected by the contact pressure with the hones 36, 38, the desired blade bevel of 5° is formed.

Generally, a critical minimum relative speed between the honing surface and the workpiece is required to generate the friction necessary to effect the removal of material from the workpiece, and consequently, sharpen the workpiece. The minimum relative speed varies according to the hone abrasive selected and the material being sharpened. Generally, beyond the minimum required speed, the faster the hone is moving, the better it can sharpen the workpiece. The hones of the present invention are rotated at a speed of at least 15,000 rpm to achieve good sharpening. In the presently preferred embodiment, the hone rotation speed is 20,000 rpm. A higher speed might be more desirable, however, rotational speed is limited by the available technology. At present, shaft drive mechanisms, for a variety of reasons, are not capable of rotational speeds above 20,000 rpm.

The hones 36, 38 are shown having the same sense of rotation, which, for the purposes of illustration, is clockwise, as indicated by arrows C and D in FIG. 6. As illustrated in FIG. 6, the contact surface 38*a* of the upper hone 38 moves in a direction opposite the direction of travel B of the blade 16. The relative speed of the hone 38 to the blade 16 is therefore the addition of the surface speed of the hone and the speed of the blade. Counter-directional rotation results in a greater speed than is possible by rotation of the hone 38 alone, and therefore improves the honing operation by increasing the relative speed. Counter-directional rotation of the hone 38 thus serves to impart a high quality sharpness and smoothness to the cutting edge 16*a*.

The surface speed of the half inch diameter hones 36, 38, ranges from about 1960 feet per minute at 15,000 rpm to about 2620 feet per minute at 20,000 rpm. Taking into account the speed of the blade, and in a presently preferred embodiment of 20,000 rpm hone rotation, the upper hone 38, rotating against the blade, thus has a surface speed relative to the blade of about 3310 feet per minute. The lower hone 36, rotating with the blade 16, has a surface speed relative to the blade of about 1925 feet per minute. The surface speed of the hones 36, 38, which is much higher than the speed of the blade 16, is advantageous in imparting the desired sharpness and finish characteristics to the blade edge 16*a* in relatively short contact time.

During sharpening against the scalloped edges, however, the upper hone 38 tends to leave burrs and ragged metal filings on the opposing side of the blade 16 in contact with the lower hone 36. To remove the burrs, the contact surface 36*a* of lower hone 36 moves in the same direction B as the blade 16. Same direction surface movement results in a lower relative speed, i.e., the subtraction of the blade speed from the surface speed of the hone. In the present embodiment, the relative speed between the lower hone 36 and the blade 16 is below the critical sharpening speed. This has the effect of causing the hone 36 to deburr and smooth the edge 16*a* of the blade 16, but, because no significant additional sharpening occurs, the lower hone 36 does not create additional burrs or metal filings on the opposite side of the blade which would have to be removed.

During the sharpening sequence, the hones 36, 38 execute repeated reciprocal axial movement along axes E. The reciprocal movement strokes the blade edge 16*a* as the hones 36, 38 rotate to maximize the area of the hone surfaces 36*a*, 38*a* used in sharpening. By stroking the blade 16, the hones, 36, 38 present a continually refreshed abrasive surface to the blade, which improves the sharpening capability of the hones. In addition, stroking distributes wear and heat from friction evenly on the hones 36, 38, which extends the life of the hones.

Figure 7:
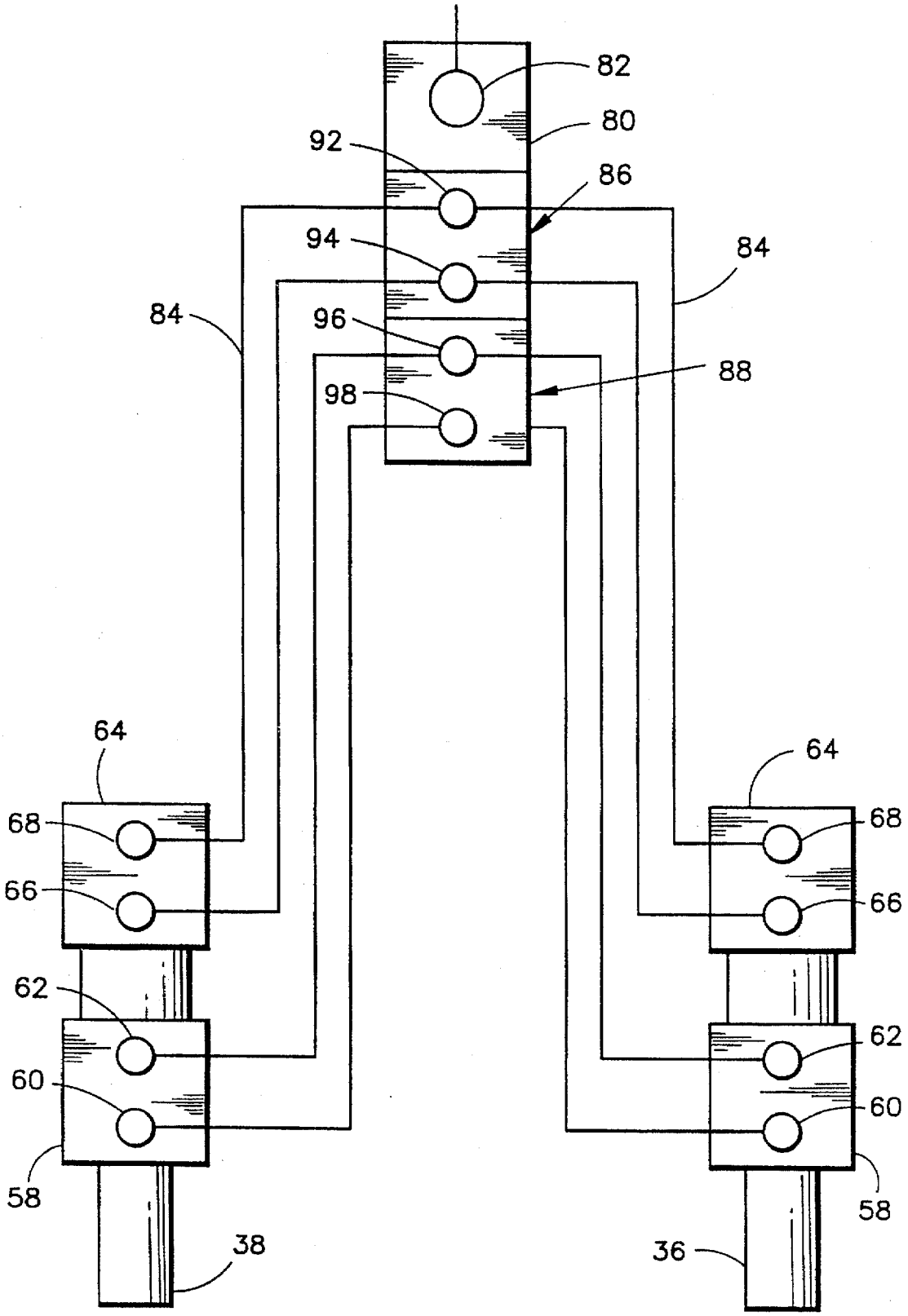
FIG. 7 is a schematic diagram of a pneumatic actuator control for controlling the movement of sharpening hones.

FIG. 7 is a schematic diagram for pneumatic control of the sharpener apparatus 32. A pneumatic control block 80 has an inlet port 82 connected to a source of pressurized air (not shown). In a preferred embodiment of the invention, the air source supplies pressurized air at 12 to 14 psi. The control block 80 includes four-way valves 86 and 88. Valve 86 controls the air flow to outlet ports 92 and 94, and valve 88 controls the air flow to outlet ports 96 and 98. The outlet ports 92–98 are connected to the rotary actuators 58 and linear slides 64 of the hones 36, 38 by air lines 84.

The rotary actuator 58 and linear slide 64 are pneumatically actuated. Air directed to appropriate inlet fittings produces a desired action by the rotary actuator 58 and linear slide 64, as follows. Air directed from outlet port 92 to fittings 68 causes the linear slide 64 to extend and move the hones 36, 38 in a forward stroke during sharpening (in the direction of arrow E in FIG. 6). Air from outlet port 94 to fittings 64 causes the linear slide 64 to retract for pulling the hones 36, 38 back to a recovery (retracted) position. During sharpening, the outlet ports 92 and 94 are cycled to produce the reciprocating stroking movement described above.

Directing air from an outlet 96 to the pneumatic fittings 62 of the rotary actuator 58 causes the rotary actuator to pivot to bring the hones into engagement with the blade to initiate the sharpening sequence, which rotation, in FIG. 5, is counterclockwise from the left about axis F. Directing air from an outlet 98 to the fittings 60 causes the rotary actuator to rotate clockwise to disengage the hones from the blade 16.

The cleaning and sharpening sequence, and method using the apparatus of the present invention, will now be described in more detail. The operation is initiated by an operator, but is carried out automatically. As has been mentioned, carton slitter blades 16, 18 require frequent cleaning and sharpening to maintain an edge sufficiently sharp for high quality recovery of tobacco, that is, recovery of tobacco with minimal levels of unwanted matter. It has been found that in continuous carton slitting operations, the blades require sharpening after use on a few hundred cartons, which can be four to five minutes use.

The sequence is initiated by an operator, which may be done by a button or switch to activate a conventional timing and switching circuit (not illustrated). A master timer to control the duration of the sharpening operation is first activated, and various timers and controls are subsequently activated to initiate and control the following steps. The slitting blades are slowed from the operative speed of about 4500 feet per second to about 690 feet per second. At or about the time the blades are slowed, the air motors 25 and 26 are activated to rotate the brushes and the actuator 28 is activated to move the brushes into an operative position in contact the blade while both the blade and the brushes are moving. The brushes are allowed to brush on the blade for an initial predetermined time to remove plastic, paper and other debris that may have adhered to the blade during previous cutting operation. The brushes are retracted preferably while still spinning, and preferably the air motors 25 and 26 are left on for a short amount of time after the brushes have been fully retracted. It is not required that the blade slow to the sharpening speed for brushing, and brushing may be initiated at any convenient time. It has also been found to be advantageous to clean the blade between sharpening operations, and the operator may initiate a cleaning sequence without sharpening. Preferably, the above blade cleaning steps are completed prior to initiation of the sharpening phase.

The initial cleaning improves the sharpening operation of the hones. Otherwise, debris from the blade would tend to transfer to the hones and a build up of debris could prevent the hone surface from contacting the blade edge.

After the predetermined initial brushing time interval, the hones begin rotation and are accelerated to an operating speed of 15,000 to 20,000 rpm. The hones are rotated so that an upper hone is rotating counter to the blade direction and a lower hone is rotating in the same direction as the blade.

After the slitting blade has been slowed to sharpening speed, and the hones have accelerated to sharpening speed, the rotary actuator is activated for bringing the hones into contact with the blade. This actuator causes the pivot rod to pivot the hones into contact with the blade and apply sufficient laterally directed force to deflect slightly the blade edge out of the operational plane in which the blade travels. A slight twist thus applied to the blade helps the hones maintain contact with the blade during sharpening.

The linear slide is then activated to move the hones reciprocally in an axial direction to stroke the blade edge at a rate of approximately once per second. The sharpening sequence is timed for 12 to 30 seconds duration. At the end of the sequence, the linear slide stops and the rotary actuator is reversed to disengage the hones from the blade. The rotation of the hones is then stopped, and the slitting blade is accelerated to slitting speed. The operator then resumes carton slitting operations.

Optionally, the brushes may be operated a second time after the sharpening operation and before resumption of slitting operations to effect additional deburring, if desired.

Figure 8:
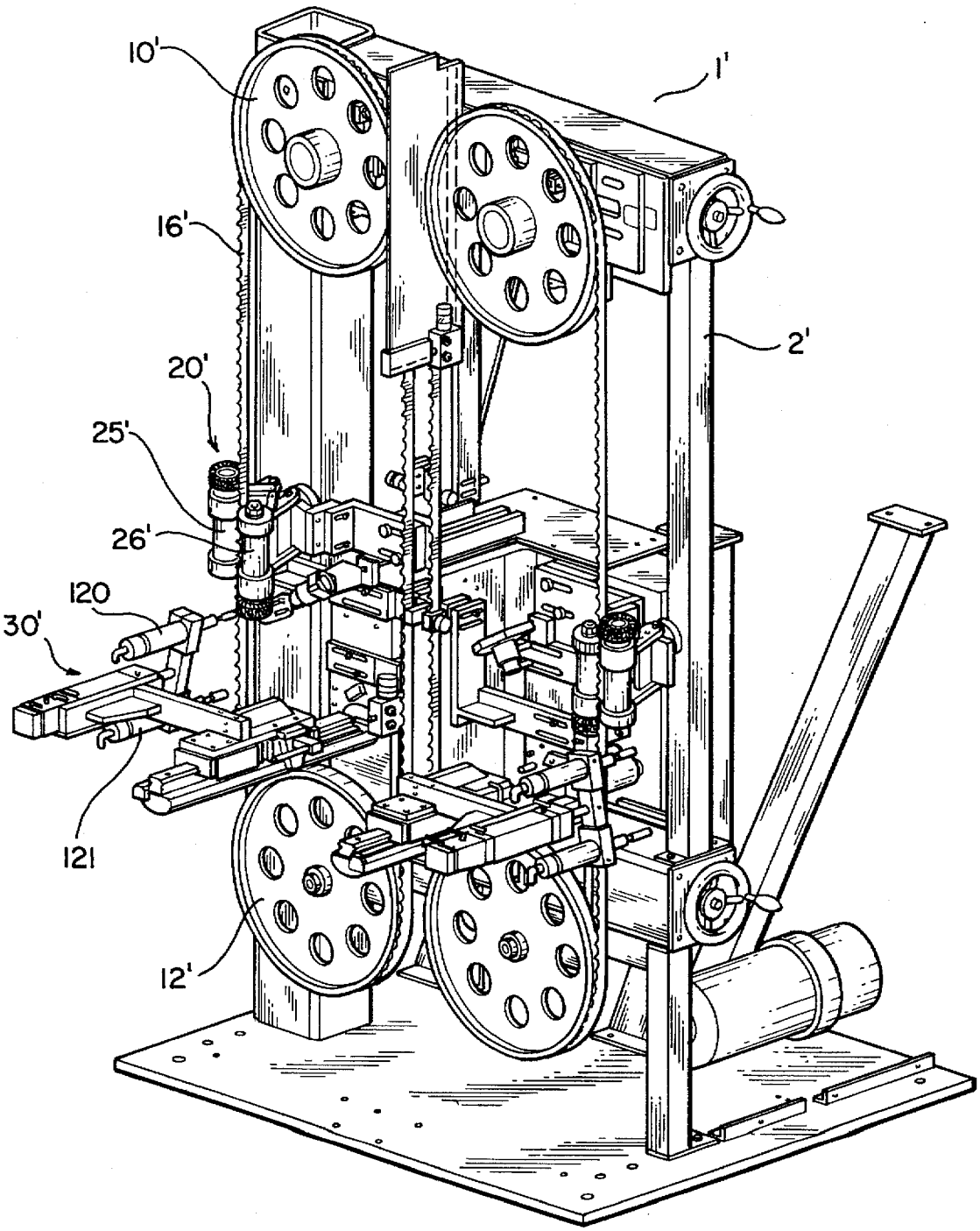
FIG. 8 is a perspective view a carton slitting machine constructed in accordance with another preferred embodiment of the present invention and featuring a blade cleaning assembly and a blade sharpener assembly of the present invention.
Figure 9:
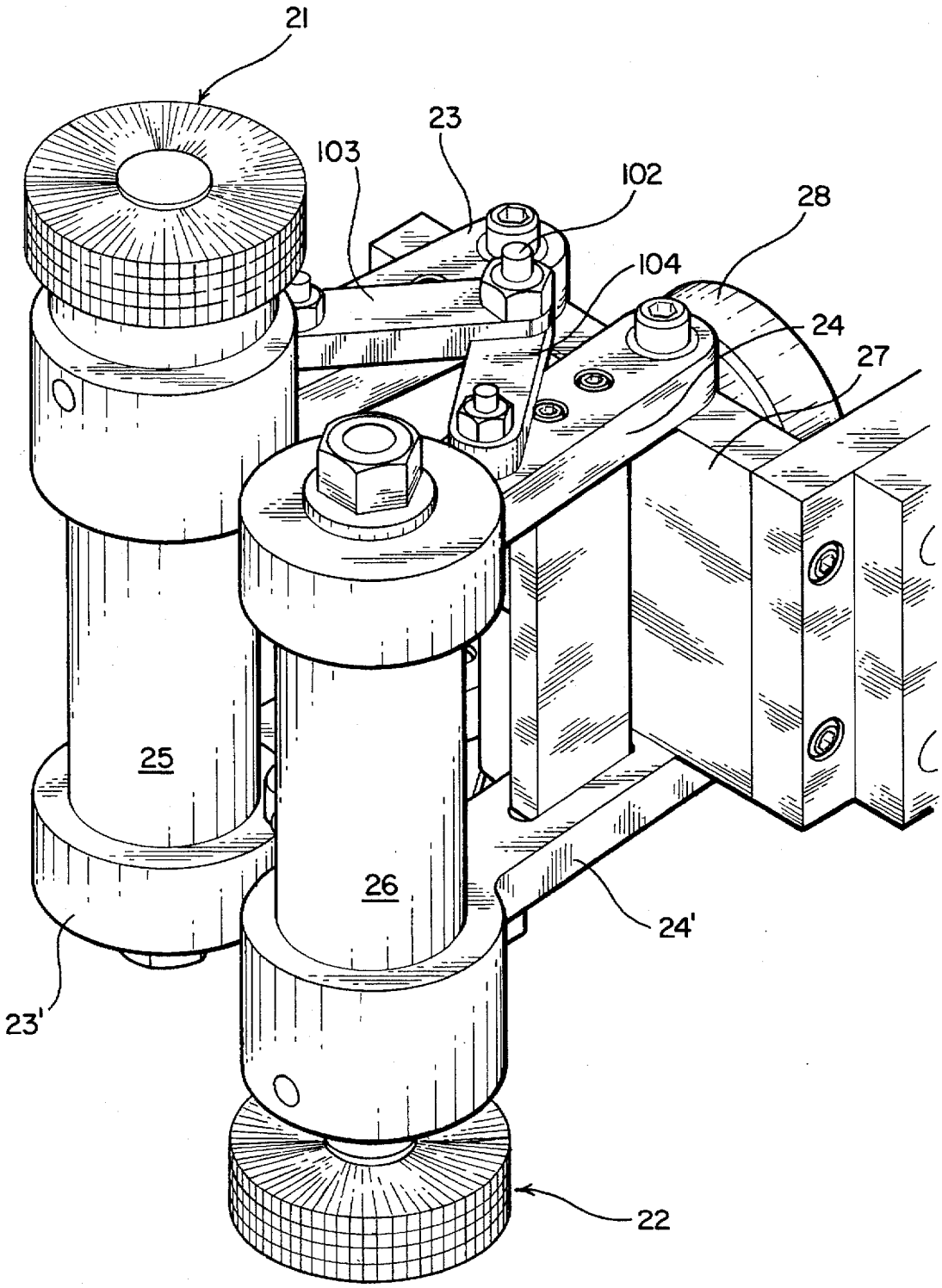
FIG. 9 is a perspective view of the brush assembly of FIG. 8.

Referring now to FIG. 8, in an alternate, preferred embodiment of the present invention, the blade cleaning assemblies 20' have been affixed to opposite side of the framework 2' of the carton slitter 1' so as to improve access and facilitate cleaning, repair and maintenance. In addition, each hone 36, 38 is driven by an air motor 120, 121, respectively, instead of flexible drive shafts as in the other embodiment, so as to facilitate maintenance. Furthermore, the air motors 25' and 26' of the brushes are pointed in opposite directions so that air motors of the same rotational direction can be used for either brush 21' or 22'.

The above-described embodiments should be regarded as illustrative rather than restrictive, and it should be appreciated that variations, changes and equivalents may be made by others without departing from the scope of the present invention as defined by the following claims.

What is claimed is:

1. A method for cleaning and sharpening a band blade in a slitting machine, comprising the steps of:

moving a band blade in a first direction;

contacting a first and a second side of a band blade with rotating brushes to remove debris from the band blade, said contacting step including the step of moving both said rotating brushes between retracted positions where said brushes are out of contact with said moving blade and operative positions where said brushes are contacting said moving blade, said brush moving step further comprising the step of rotating said brushes throughout movement between said retracted and operative positions;

moving a first rotating hone into contact with the first side of the band blade at a preselected sharpening angle for a cutting edge;

moving a second rotating hone into contact with the second side of the band blade at a preselected sharpening angle for the cutting edge; and moving the hones in repeated reciprocal movements transverse to the blade direction to stroke the cutting edge as the hones rotate.

2. A method for cleaning and sharpening a band blade in a slitting machine, comprising the steps of;

contacting a first and a second side of a band blade with rotating brushes to remove debris from the band blade;

moving a first rotating hone into contact with the first side of the band blade at a preselected sharpening angle for a cutting edge;

moving a second rotating hone into contact with the second side of the band blade at a preselected sharpening angle for the cutting edge; and moving the hones in repeated reciprocal movements transverse to the blade direction to stroke the cutting edge as the hones rotate;

wherein the first hone is rotated so that a surface of the first hone is moving counter to the blade direction; and the second cylindrical hone is rotated so that a surface of the second hone is moving in the blade direction.

3. The method as claimed in claim 1, wherein the brushes are rotated to move from a rear edge portion of the blade to the cutting edge.

4. A method for cleaning and sharpening a band blade in a slitting machine, comprising the steps of:

running a band blade in a machine at a sharpening speed;

contacting opposing sides of the band blade with rotating brushes;

rotating a first cylindrical hone so that a surface of the first hone is moving counter to the blade direction;

rotating a second cylindrical hone so that a surface of the second hone is moving in the blade direction;

moving the first and second hones in a direction transverse to a blade length and parallel to a blade width;

moving the first and second hones relative to a cutting edge of the blade to contact one side of the cutting edge at a preselected sharpening angle with the first rotating hone for sharpening the cutting edge and to contact an opposing side of the cutting edge at a preselected angle with the second rotating hone for deburring the cutting edge; and, moving the hones in repeated reciprocal movements transverse to the blade direction to stroke the cutting edge as the hones rotate.

5. The method as claimed in claim 4, wherein the brushes are rotated to move from a rear edge portion of the blade to the cutting edge.

6. The method as claimed in claim 4, wherein the brushes are retracted away from said band blade before the hones are contacted with the band blade.

7. The method as claimed in claim 4, wherein the blade is a scalloped-edge blade and the sharpening speed is about ⅛ to 1/10 of an operational slitting speed.

8. The method as claimed in claim 4, wherein the first and second hones are rotated so that a speed of the surface of each of the hones is greater than the sharpening speed of the blade.

9. The method as claimed in claim 4, wherein the first and second hones are rotated so that a speed of the surface of each of the hones is in the range of about 1960 feet per minute to 2620 feet per minute.

10. The method as claimed in claim 4, wherein the first and second hones are rotated at 15,000 to 20,000 revolutions per minute.

11. The method as claimed in claim 4, wherein the first and second hones are moved in repeated reciprocal movement at a rate of once per second while both of the hones are in contact with the blade during the sharpening operation.

12. The method as claimed in claim 4, wherein the reciprocal movement of the first and second hones is controlled so that duration of contact with the blade is equally distributed along the hone surface.

13. The method as claimed in claim 4, wherein the first and second hones contact the blade edge with sufficient lateral force to deflect the blade from an operational plane.

14. The method as claimed in claim 4, wherein the first and second hones contact the blade edge at an angle of 7° to 10° to the operational plane of the blade.

15. The method as claimed in claim 4, wherein the steps of contacting one side of the cutting edge and contacting an opposing side of the cutting edge comprise moving the first rotating hone from a position out of contact with the band blade to a position in contact with the band blade, and moving the second rotating hone from a position out of contact with the band blade to a position in contact with the band blade.

16. An apparatus for cleaning and sharpening an endless band blade in a slitting machine, comprising:

a first brush assembly located adjacent one side of a blade and a second brush assembly located adjacent an opposite side of said blade, each said brush assembly comprising a brush, means for rotating the brush and a pivotal support so that each brush assembly is movable between a retracted position out of contact with said blade and an operative position in contact with said blade;

a first actuator operatively connected with said pivotal supports to move said brush assemblies controllably between said retracted and operative positions;

a second actuator for reciprocating movement transverse to a blade length direction and parallel to a blade width direction;

a third actuator mounted to the second actuator for movement relative to a blade cutting edge plane;

a first cylindrical rotatable hone attached to the third actuator and extending in the blade width direction;

a second cylindrical rotatable hone attached to the third actuator and extending in the blade width direction;

means for rotating the first and second hones; and, means for controlling the third actuator so that movement of the third actuator in a first direction causes the first and second hones to move into contact with a cutting edge of the blade for sharpening and movement in a second direction causes the first and second hones to move out of contact with the cutting edge.

17. The apparatus as claimed in claim 16, wherein an axis of rotation of each of the first and second brushes is parallel to a blade movement direction.

18. The apparatus as claimed in claim 16, wherein the means for rotating the brushes rotates each brush for contact with the blade from a rear edge toward a cutting edge.

19. The apparatus as claimed in claim 16, wherein the first actuator is an air cylinder which is operatively connected with said pivotal supports through pivotal drive linkage.

20. The apparatus as claimed in claim 16, wherein the third actuator includes a pivot bar having an upper and lower end, the first hone being attached to the upper end of the pivot bar and extending in the blade width direction and the second hone being attached to the lower end of the pivot bar and extending in the blade width direction, wherein the second actuator executes a pivoting movement to bring the first and second hones into contact with the blade edge.

21. The apparatus as claimed in claim 16, wherein the means for rotating the hones rotates the first hone so that a surface of the first hone travels opposite to the direction of travel of the blade and rotates the second hone so that a surface of the second hone travels in the same direction of travel as the blade.

22. The apparatus as claimed in claim 16, wherein the means for rotating the first and second hones includes a motor coupled to the hones by a flexible drive shaft.

23. The apparatus as claimed in claim 16, wherein the means for rotating the first and second hones rotates the hones at 15,000 to 20,000 rpm.

24. The apparatus as claimed in claim 16, wherein the means for rotating the first and second hones rotates the hones for a surface speed in the range of about 1960 feet per minute to 2620 feet per minute.

25. The apparatus as claimed in claim 16, wherein the first and second hones are positioned to contact the blade edge at an angle for forming a 5° bevel on the edge.

26. The apparatus as claimed in claim 25, wherein the first and second hones are positioned to contact the blade edge at an angle of 7° to 10° to the operational plane of the blade.

27. The apparatus as claimed in claim 16, wherein the first actuator is operated pneumatically, and the means for controlling the first actuator includes a valve to control the flow of pressurized air to the first actuator.

28. The apparatus as claimed in claim 16, wherein the second actuator is operate pneumatically and the means for controlling the second actuator includes a valve to control the flow of pressurized air to the second actuator.

29. The apparatus as claimed in claim 16, wherein the means for controlling the first actuator causes reciprocal movement of the first and second hones so that contact with the blade is equally distributed along a hone surface.

30. The method as claimed in claim 2, wherein the brushes are rotated to move from a rear edge portion of the blade to the cutting edge.

* * * * *